US005685419A

United States Patent [19]

Takano

[11] Patent Number: 5,685,419

[45] Date of Patent: Nov. 11, 1997

[54] LEVER SWITCH

[75] Inventor: Tsunesuke Takano, Tokyo, Japan

[73] Assignee: Daichi Denso Buhin Co., Ltd., Japan

[21] Appl. No.: 689,600

[22] Filed: Aug. 12, 1996

[30] Foreign Application Priority Data

Sep. 7, 1995 [JP] Japan ..... 7-255687
Sep. 27, 1995 [JP] Japan ..... 7-272043

[51] Int. Cl.[6] ..... H01H 15/02

[52] U.S. Cl. ..... 200/563; 200/556; 200/562

[58] Field of Search ..... 200/563, 562, 200/561, 556, 553, 339, 549

[56] References Cited

U.S. PATENT DOCUMENTS

| | | | |
|---|---|---|---|
| 1,422,447 | 7/1922 | Kelsay | 200/563 |
| 3,858,012 | 12/1974 | Lockard . | |
| 4,000,383 | 12/1976 | Lockard . | |
| 4,272,662 | 6/1981 | Simpson . | |
| 4,383,155 | 5/1983 | Tenner | 200/339 |
| 4,778,964 | 10/1988 | Kamisada . | |
| 5,099,095 | 3/1992 | Takano . | |

FOREIGN PATENT DOCUMENTS

| | | | |
|---|---|---|---|
| 1084341 | 6/1960 | Germany | 200/563 |
| 2-145742 | 12/1990 | Japan . | |

*Primary Examiner*—David J. Walczak
*Attorney, Agent, or Firm*—Nixon & Vanderhye P.C.

[57] ABSTRACT

A lever switch includes an insulating substrate formed from a plastics material which has opposed substrate walls protruding from a surface thereof. An operating lever is positioned between and hingedly connected to the opposed substrate walls so as to be pivotally movable between at least first and second positions. A movable contact piece, which has a pair of contact regions, is positioned at a lower end of the operating lever so as to be movable therewith between said first and second positions. A pair of fixed contact piece supporting walls each extend from a respective one of the opposed substrate walls. First and second conductive fixed contact pieces are positioned on respective inner surfaces of one and another of the fixed contact piece supporting walls such that the movable contact piece is positioned therebetween and is capable of contact therewith when the lever is pivoted between the first and second positions. The first and second fixed contact pieces each have a portion which extends to an exterior of the fixed contact piece supporting walls. The first contact piece has a depression in an inner surface thereof and the second fixed contact piece is positioned in opposition to the depression. In such a manner, the contact regions of the movable contact make electrical contact with the depression and the second fixed contact piece when the lever is in one of its first and second positions.

6 Claims, 7 Drawing Sheets

LEVER SWITCH

INDUSTRIAL FIELD OF APPLICATION

This invention relates to a lever switch suitable for use as a switch in, for example, an interior automobile lamp.

BACKGROUND OF THE INVENTION

Examples of conventional lever switches are disclosed in Japanese UM Laid-Open No. 2-145742 and its corresponding U.S. Pat. No. 5,099,095 as well as other U.S. Pat. Nos. 4,272,662, 4,778,964, 3,858,012 and 4,000,383.

U.S. Pat. No. 5,099,095 relates to an application of the inventor of the present application, and application on which it is based is the above-mentioned Japanese UM Laid-Open No. 2-145742.

U.S. Pat. No. 5,099,095 discloses a lever switch having an insulating base formed from plastic, hinge bosses formed in opposition to this base, and an operating lever that pivots in the holes (indentations) of its hinge pieces that form a pair with the hinge bosses. A thin-walled bridging piece is provided that occupies the lower portion of the hole (indentations) formed in the lower portion of the operating lever. A generally roughly U-shaped movable contact piece is inserted into this bridging piece and has a pair of opposing contact points about the above-mentioned hole (indentation). First and second contact pieces are attached to the above-mentioned base on both sides of the movable contact piece.

In the above-mentioned prior art, the operating lever is rotated using the above-mentioned hinge bosses as a fulcrum. Electrical continuity can thus be established between each of the first and second contact pieces with the movable contact piece inserted into the lower bridging piece of this operating lever, thereby enabling the lighting of, for example, a straight tube lamp.

In addition, by tilting the operating lever to interrupt the electrical continuity between each of the fixed contact pieces, a straight tube lamp, for example, can be turned off. In this example of the prior art, however, when performing the switching operation of the operating lever, since there are no means for obtaining a sense of moderation, namely the feel of the timing of the switching operation generally in terms of a clicking action or snapping sensation, only an unreliable switching sensation is able to be obtained. As a result, users may be apprehensive about its operation. Further, the lamp may be turned off even when the operating lever is moved slightly.

SUMMARY OF THE INVENTION

In order to eliminate each of the above-mentioned problems, the object of the invention is to provide a sense of switching moderation, namely to obtain a clicking action. Such switching operation will ensure that the switching is done smoothly without flickering of the lamp. In addition, the lever switch may be provided inexpensively.

The above-mentioned object of the invention was able to be achieved by providing opposing walls protruding from one surface of an insulating substrate formed from plastic. Hinge pieces are positioned on both sides of an operating lever with a hinge mechanism in a pivoting fashion. A movable generally U-shaped contact piece is provided which is formed from a resilient conductor having a pair of contact points. The movable contact piece is mounted at the lower portion of the above-mentioned operating lever. Fixed contact piece supporting walls extend from the opposing walls with the movable contact piece mounted therebetween. One fixed contact piece is arranged on the inner surface of one fixed contact piece supporting wall, while at least one other plurality of fixed contact pieces on the inner surface of the other fixed contact piece supporting wall. The lever switch will thus have each of these fixed contact pieces led to the outside of the support plates so as to form a portion of a distribution member. A wide fixed contact piece may thus be provided that forms depressions in the inner surface of one fixed contact piece supporting wall, while narrow fixed contact pieces are arranged in opposition to the depressions on the inner surface of the other fixed contact piece supporting wall.

DETAILED DESCRIPTION OF THE INVENTION

Figure 1A:
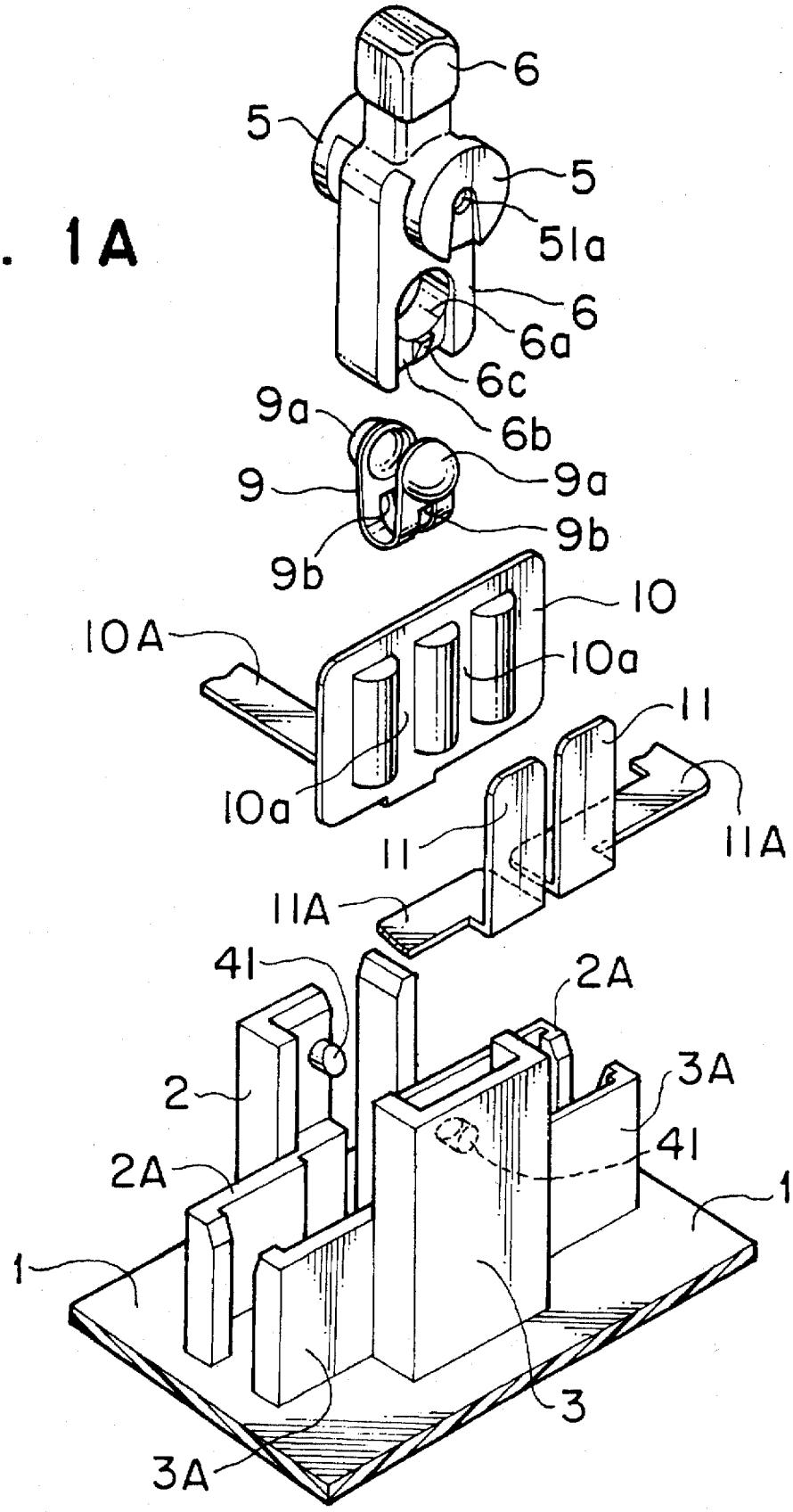
FIG. 1A is an exploded perspective view of the lever switch of the present invention.
Figure 2A:
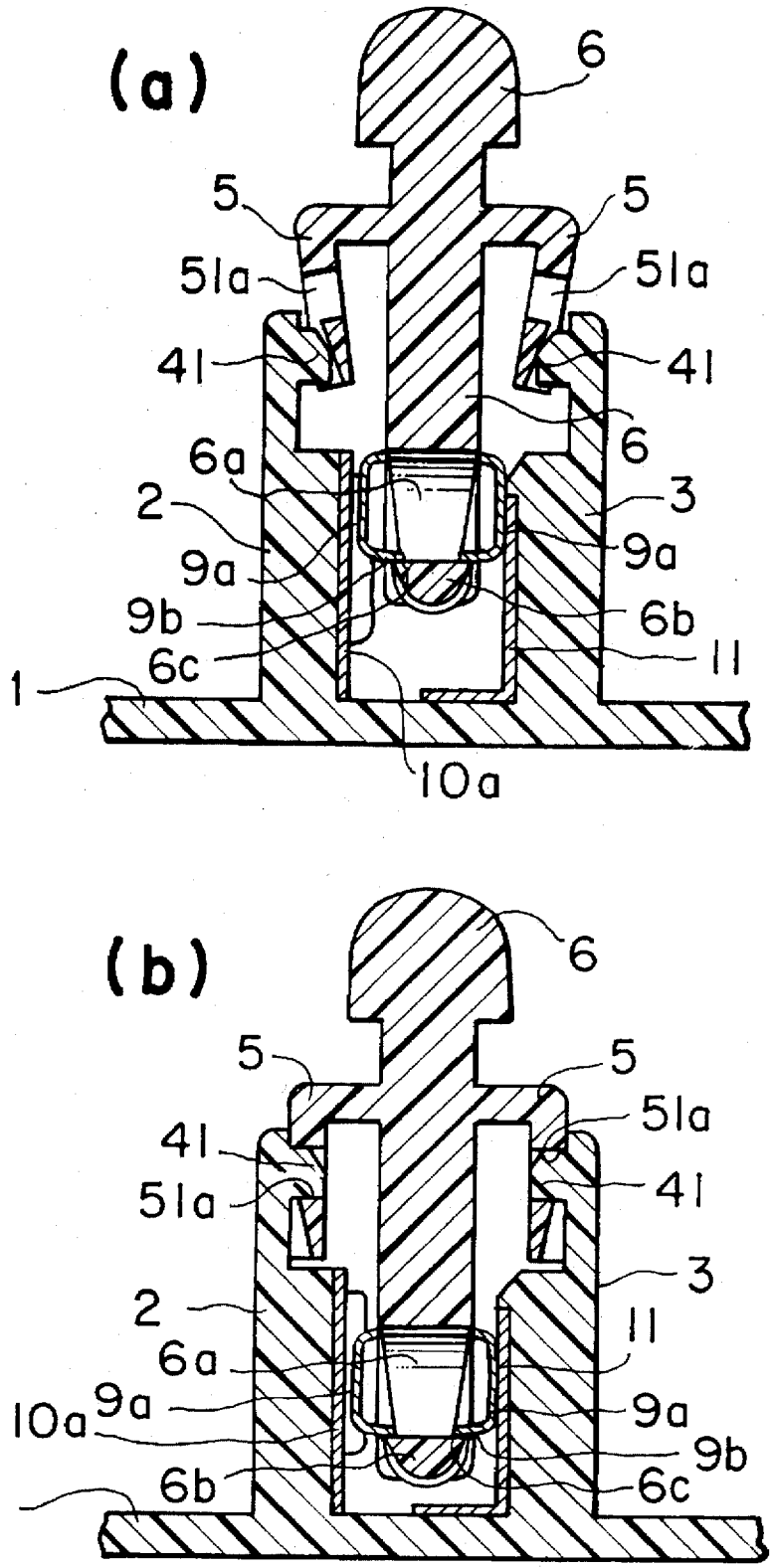
FIG. 2A is a vertical cross-sectional view of the lever switch of the present invention during assembly and after assembly.

As shown in FIGS. 1A and 2A, in the basic form of the invention, opposing walls 2 and 3 are provided projecting from and integrated into a single unit with the upper surface of insulating base 1 formed from a plastic such as polypropylene or ABS plastic. Hinge pieces 5 of operating lever 6 also formed from plastic make contact with hinge bosses 41 formed in opposition to each other on the inner surface of each opposing wall 2 and 3. Hinge pieces 5 engage with the above-mentioned bosses with their holes 51*a* while deflecting inward as shown in FIG. 2A(*a*). Operating lever 6 is supported in pivoting fashion by the above-mentioned opposing walls 2 and 3 as shown in FIG. 2A(*b*).

Figure 1B:
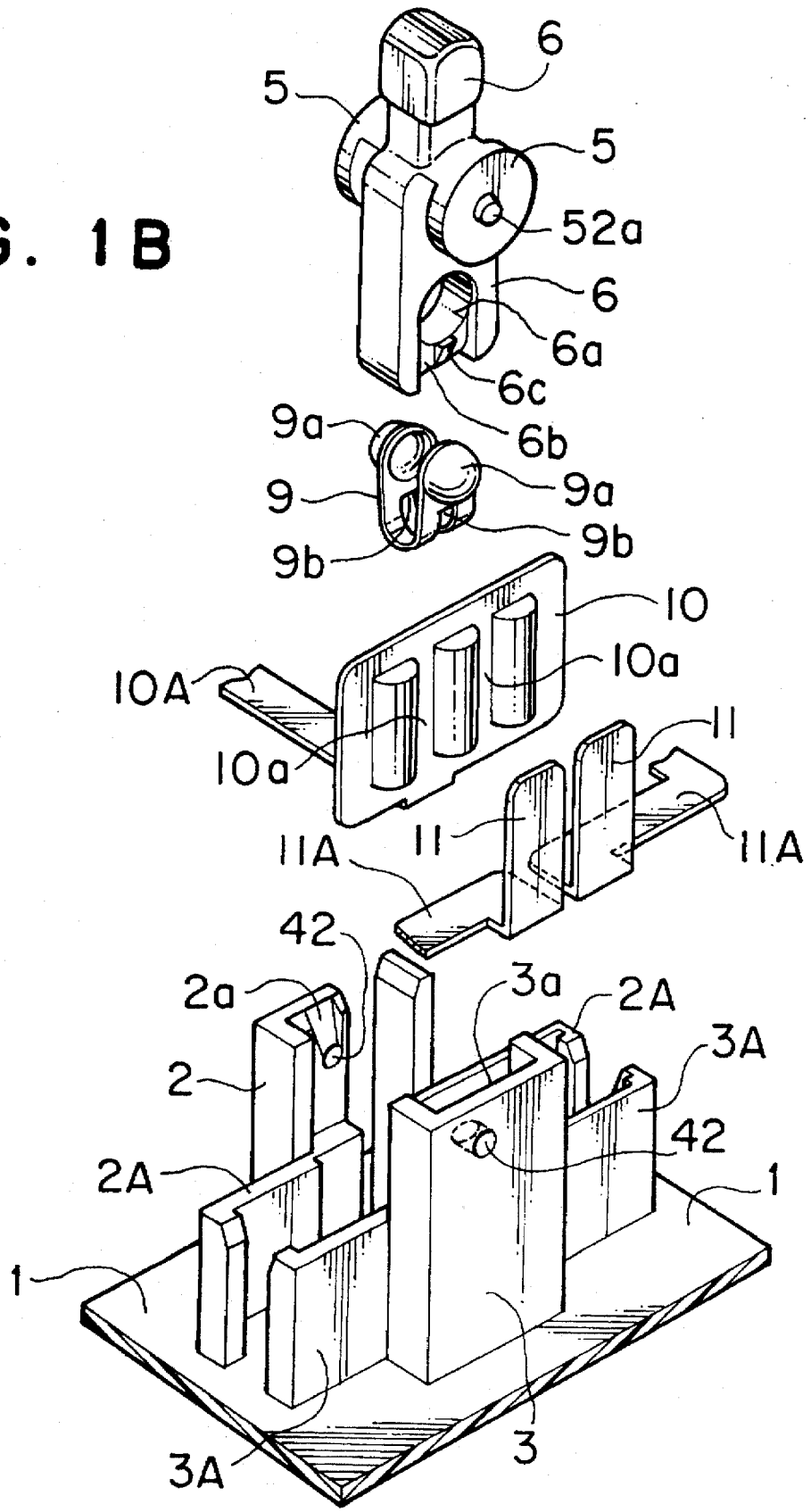
FIG. 1B is an exploded perspective view of a lever switch of another embodiment of the present invention.
Figure 2B:
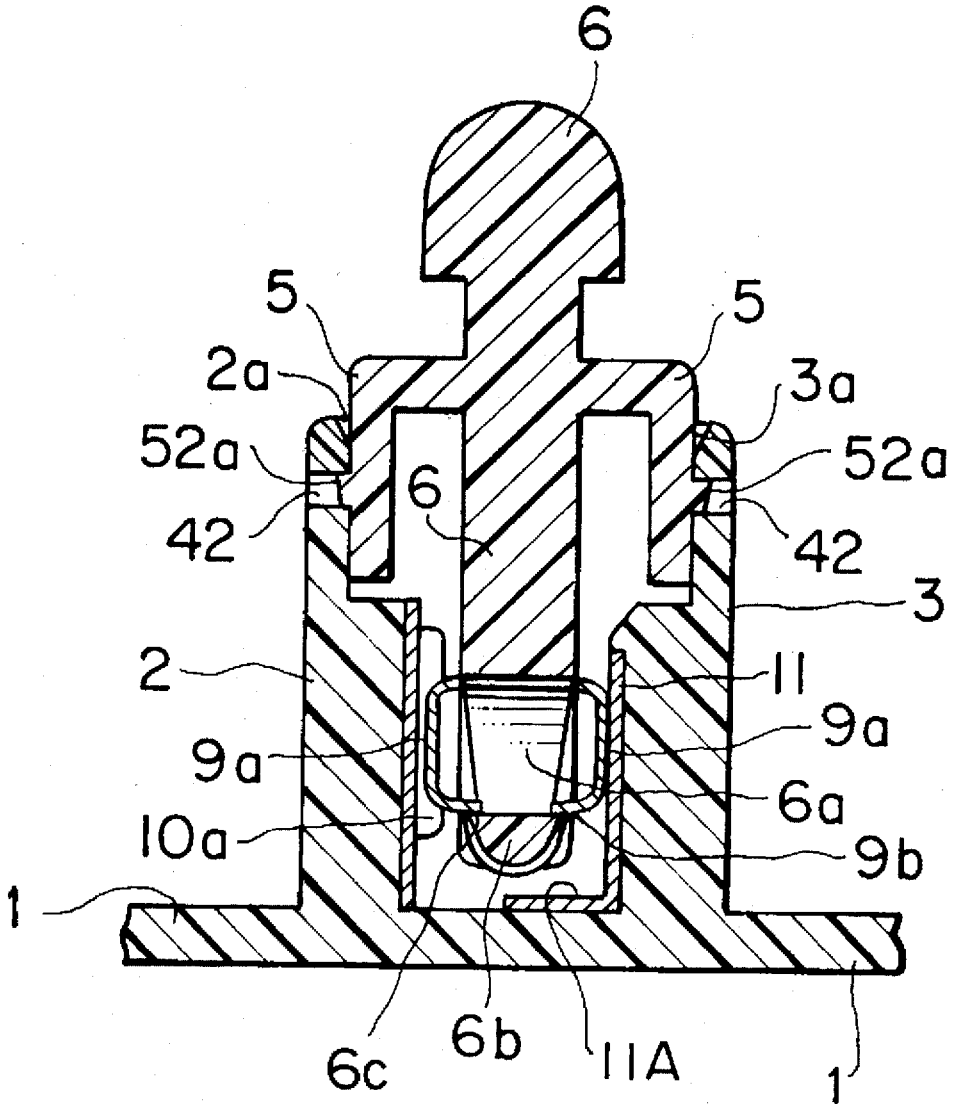
FIG. 2B is a vertical cross-sectional view of the lever switch of another embodiment of the present invention after assembly.

As shown in FIGS. 1B and 2B, in another embodiment of the present invention, opposing walls 2 and 3 are provided projecting from and integrated into a single unit with the upper surface of insulating base 1 formed from a plastic such as polypropylene or ABS plastic. Hinge bosses 52*a* of hinge pieces 5 formed on operating lever 6 and also formed from plastic and make contact with inclined boss guide surfaces 2*a* and 3*a* formed in opposition to each other on the inner surfaces of the upper portion of each opposing wall 2 and 3. Hinge bosses 52*a* engage with hinge holes 42 of opposing walls 2 and 3 after passing over the above-mentioned inclined surfaces 2*a* and 3*a* while hinge pieces 5 are deflected inward in opposition to their resiliency. Operating lever 6 is supported in pivoting fashion by the above-mentioned opposing walls 2 and 3 as shown in FIG. 2B.

Furthermore, operating lever 6 may be supported in pivoting fashion by opposing walls 2 and 3 while the upper portions of opposing walls 2 and 3 are deflected outward in opposition to their resiliency.

Locking tabs 6c are formed facing upward as shown in FIG. 1A on the operating lever 6 roughly in the center of bridging piece 6b that occupies the lower portion of hole 6a formed in advance in its lower portion. Movable contact piece 9, formed roughly into the shape of the letter "U" from a resilient conductor strip of phosphor bronze and the like, has a pair of contact points 9a which oppose these locking tabs 6c within the hole 6a. The moveable contact piece 9 is reliably provided by engaging and locking with locking edges 9b in opposition to its resiliency as shown in FIGS. 2A(*a*) and 2A(*b*).

Figure 3A:
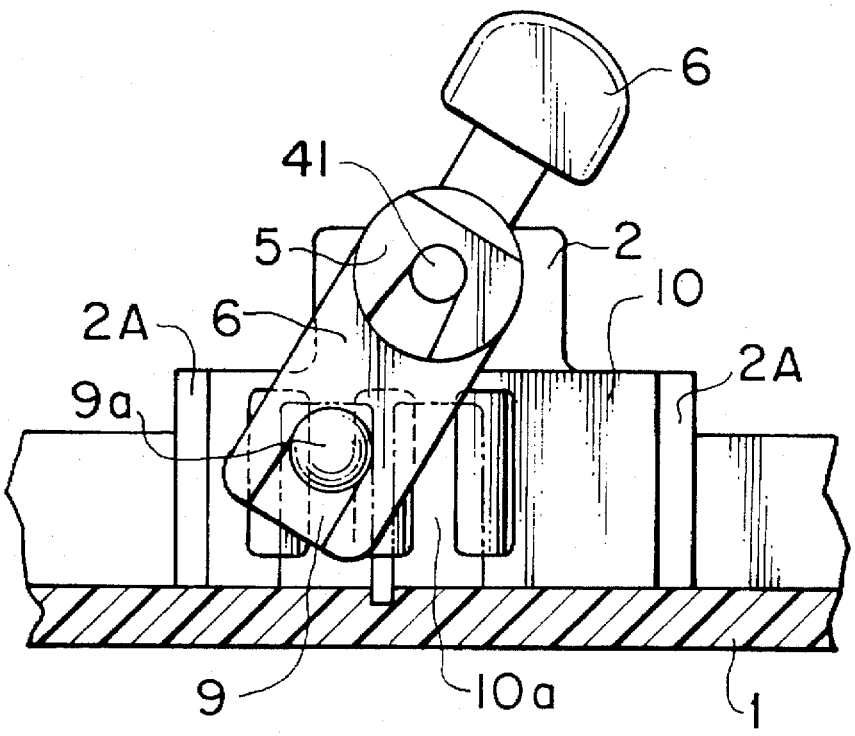
FIGS. 3A and 3B are an explanatory drawing showing an operating state of the lever switch of the present invention.
Figure 3B:
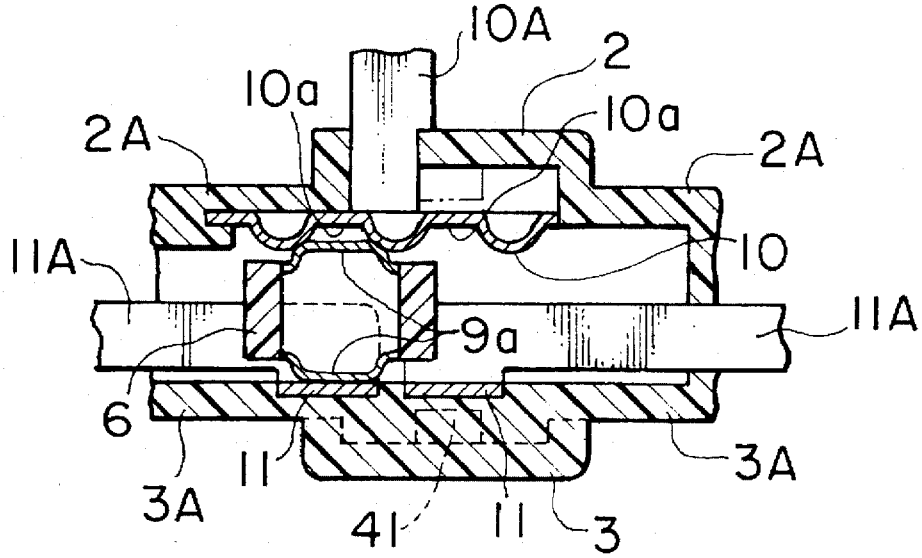

Wide fixed contact piece 10 as shown FIG. 2A(*b*) and FIG. 3B, may be provided with depressions 10a and arranged the inner surface of fixed contact piece guide groove of one fixed contact piece supporting wall 2A of wide fixed contact piece supporting walls 2A and 3A. Each supporting wall is thus formed to extend into a single integrated unit as shown in FIG. 1A from the opposing walls 2 and 3 about movable contact piece. Two narrow fixed contact pieces 11 that oppose the depressions 10a are arranged on the inner surface of the other fixed contact piece supporting wall 3A as shown in FIGS. 2A and 3B. The number of the narrow fixed contact pieces may be selected in accordance with the switch circuit used. One or plural fixed contact pieces can be used. A switch having two fixed contact pieces 11 is shown in the drawing, but it can be said, of course, that only one fixed contact piece can be used for an on-off switch.

Moreover, these fixed contact pieces 10 and 11 are led to the outside of the above-mentioned fixed contact piece supporting walls 2A and 3A as shown in FIG. 3(B), and lead portions 10A and 11A serve as distribution members that extend integrated into a single unit. A portion of these lead portions forms the fixed contact pieces 10 and 11, thereby composing the lever switch according to the present invention.

The constitution of the present invention has been described above. Next, the following provides an explanation of the operation of the lever switch of the present invention.

Figure 4A:
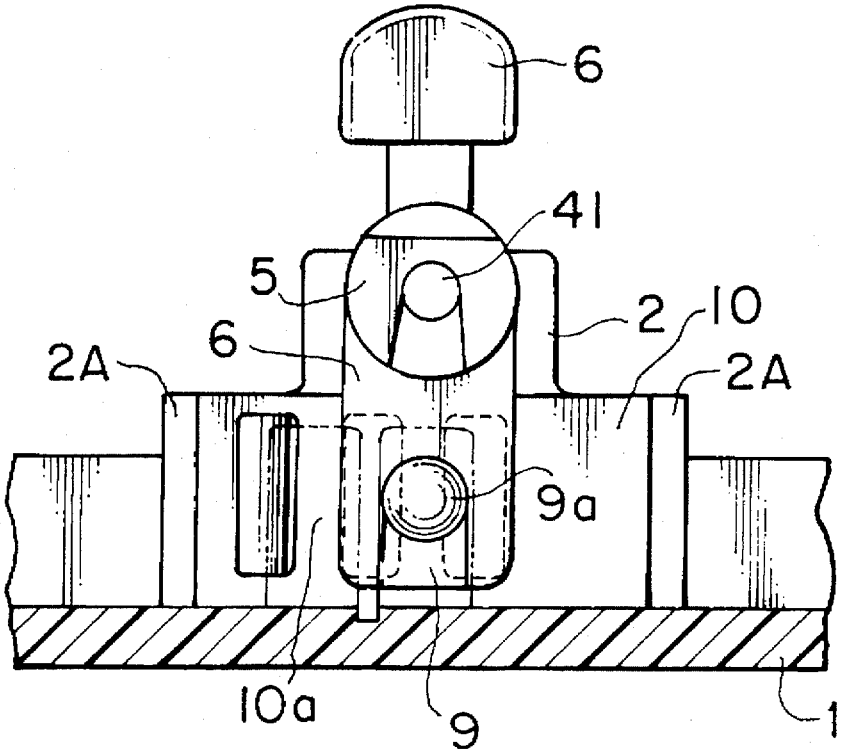
FIGS. 4A and 4B are an explanatory drawing showing an operating state of the lever switch of the present invention.
Figure 4B:
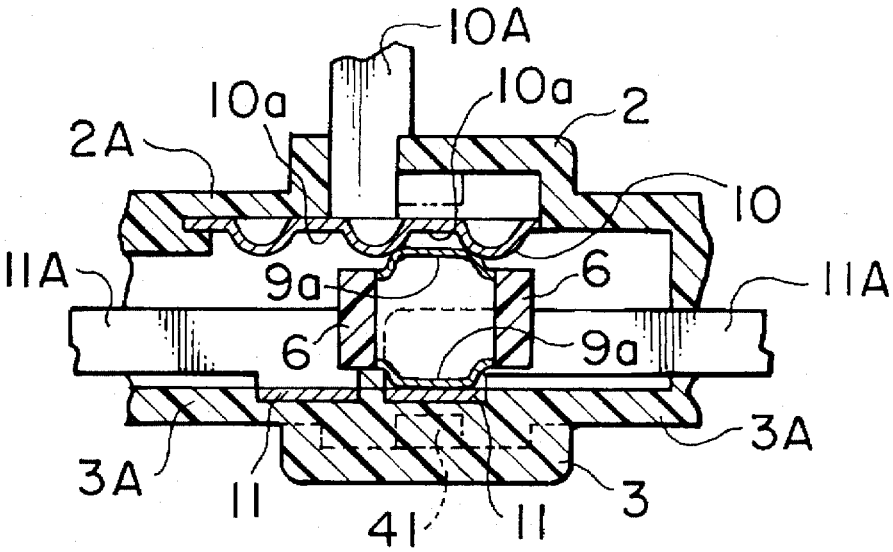
Figure 5A:
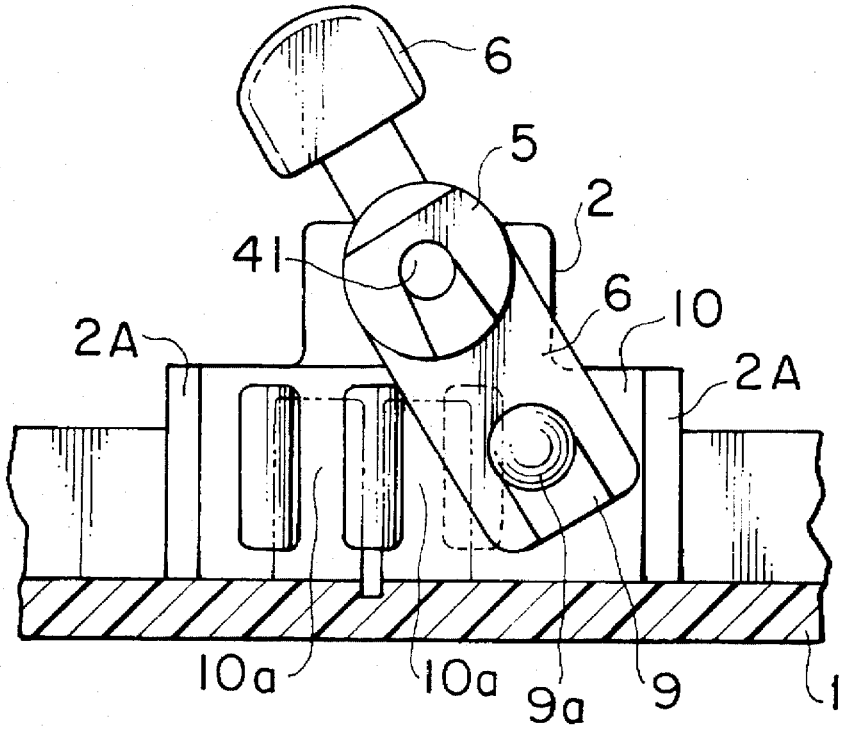
FIGS. 5A and 5B are an explanatory drawing showing an operating state of the lever switch of the present invention.
Figure 5B:
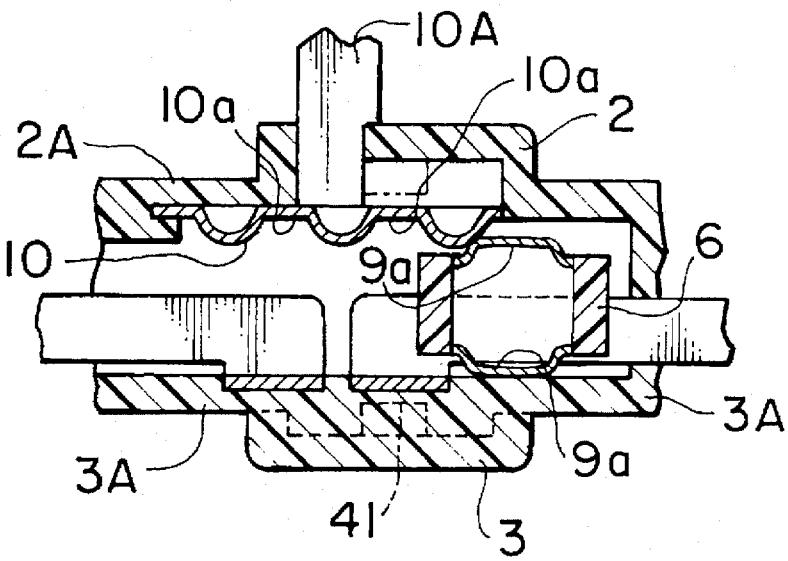

As shown in each of the drawings of FIG. 3 through FIG. 5, in the lever switch of the present invention, the operating lever 6 may be pivoted by virtue of its having a pair of hinge pieces that pivots as shown in FIG. 2A(*b*) on hinge bosses 41 provided in opposition to each other on opposing walls 2 and 3 formed integral with base 1. Such operation causes the movable contact piece 9 to be compressed against its resiliency from the state shown in FIG. 3 to the state shown in FIG. 4 using the hinge bosses 41 as a fulcrum. Each of two narrow fixed contact pieces 11 are able to be switched with respect to wide fixed contact piece 10 to establish continuity from the state shown in FIG. 3 to the state shown in FIG. 4 with movable contact piece 9 inserted into lower bridging piece 6b of this operating lever 6. As a result, for example, two small and large automobile interior lamps may be lit by switching to a state of mutual electrical continuity with respect to a power line. For the switch, the purpose of which is to merely make on-off operation, only one narrow fixed contact piece 11 may be used.

Also, for such switch, only one depression 10a of wide fixed contact piece 10 may be sufficient.

In performing this switching, the outside of movable contact piece 9 drops into depressions 10a of wide fixed contact piece 10 with a snapping action due its own resiliency, thus enabling the obtaining of a sense of moderation in the switching action, namely a clicking action, and allowing the switching timing to be confirmed by a tactile sensation or by a clicking sound.

The width of fixed contact piece 11 may also be designed so that one contact point of movable contact piece 9 is in contact with fixed contact piece 11. Such a design will keep the electrical continuity when the other contact point of movable contact piece 9 is positioned at the crest of wide fixed contact piece 10. The electrical continuity can thus be kept until just before the a clicking action is finished without interruption of the electrical continuity during the clicking action.

Further, in a changeover switch using two fixed contact pieces 11 as illustrated in the drawing, the flickering of the lamp can be prevented. That is, electrical continuity is kept at the time of changeover of the switch by designing the gap between these two fixed contact piece 11 to be narrower than the width of contact point of movable contact piece 9a as shown in FIG. 1A and FIG. 3B.

Next, by further tilting operating lever 6 in the same direction as shown in FIG. 5 to interrupt the continuity between fixed contact pieces 10 and 11, for example, both of the above-mentioned lamps can be turned off.

Furthermore, a sense of moderation in switching at this time can also be obtained in the same manner as during the above-mentioned switching.

The vertical movement and horizontal movement of operating lever 6 is blocked by the entire circumferential surface of holes (or indentation) 51a of hinges 5 that pivot on each hinge boss 41. Thus, operating lever 6 cannot come out of base 1, and movable contact piece 9 cannot be inadvertently pulled from or shifted out of position from locking tabs 6c of operating lever 6 due to the locking action resulting from its own resiliency.

Namely, since the above-mentioned U-shaped movable contact piece 9 is attached to locking tabs 6c of bridging piece 6 formed in operating lever 6 with its locking edges 9b by resiliently making contact and being clamped in position, it is not inadvertently pulled out or shifted out of position by an external force such as the operating stress of operating lever 6, thus enabling it to reliably establish or interrupt electrical continuity between fixed contact pieces 10 and 11.

Furthermore, holes 51a of hinges 5 of operating lever 6 and hole 6a of the lower portion of operating lever 6 may be in the form of depressions into which hinge bosses 41 enter and a depression into which a portion of movable contact piece 9 enters, respectively.

A constitution of another embodiment is composed so that operating lever 6, having a pair of hinge pieces that pivot as shown in FIG. 2B in hinge holes 42 provided in opposition to each other in opposing walls 2 and 3 of base 1, is operated by rotating using hinge bosses 52a as a fulcrum.

The vertical movement and horizontal movement of operating lever 6 is blocked with the entire circumferential surface of hinge bosses 52a of hinge pieces 5 that respectively pivot in hinge holes (or depressions) 42. Thus, operating lever 6 cannot come out of base 1, and movable contact piece 9 cannot be inadvertently pulled from or shifted out of position from locking tabs 6c of operating lever 6 due to the locking action resulting from its own resiliency.

Effects of the Invention

As a result of being composed as described above, the present invention demonstrates the following effects.

In performing the switching operation of operating lever 6, the outside of movable contact piece 9 drops into depressions 10*a* of wide fixed contact piece 10 among two opposing fixed contact pieces 10 and 11 with a snapping action due its own resiliency, thus enabling the obtaining of a sense of moderation, namely a clicking action, when establishing continuity by switching, and allowing the timing by which continuity is established by switching to be confirmed by sensation or a by a clicking sound, thus offering a 1st effect of the present invention.

In addition, since the movable contact piece according to the present invention combines the use of the resilient action for establishing continuity of its inherent resiliency with respect to a fixed contact piece, and the clicking action resulting from the mechanical dropping action with respect to depressions 10*a* of a fixed contact piece, special-purpose members for obtaining a sense of moderation of the switching timing of operating lever 6, for example depressions in the switch case itself or steel balls or coil springs that drop into these depressions, are not required at all, thus offering a 2nd effect of the present invention of being economical in terms of both space and cost.

Furthermore, if the width of fixed contact piece 11 is designed so that one contact point of movable contact piece 9 is in contact with fixed contact piece 11 to keep the electrical continuity when the other contact point of movable contact piece 9 is positioned at the crest of wide fixed contact piece 10, the electrical continuity can be kept just before the finishing of a clicking action without interruption of the electrical continuity during the clicking action. Therefore, such a problem that the electrical continuity is interrupted even with a slight movement of the operating lever can be eliminated, thus offering a 3rd effect of the present invention.

In addition, in a changeover switch according to the present invention, the flickering of the lamp can be prevented, because electrical continuity is kept at the time of changeover of the switch by designing the gap between these two fixed contact pieces 11 to be narrower than the width of contact point of movable contact piece 9*a*, thus offering a 4th effect of the present invention.

I claim:

1. A lever switch comprising:

an insulating substrate formed from a plastics material which has opposed substrate walls protruding from a surface thereof;

an operating lever positioned between and hingedly connected to said opposed substrate walls so as to be pivotally movable between at least first and second positions;

a movable contact piece positioned at a lower end of said operating lever so as to be movable therewith between said first and second positions, said movable contact piece having a pair of contact regions;

a pair of fixed contact piece supporting walls each extending from a respective one of said opposed substrate walls;

first and second conductive fixed contact pieces positioned on respective inner surfaces of one and another of said fixed contact piece supporting walls such that said movable contact piece is positioned therebetween and is capable of contact therewith when said lever is pivoted between said first and second positions; wherein said first and second fixed contact pieces each have a portion which extends to an exterior of said fixed contact piece supporting walls; and wherein said first contact piece has a depression in an inner surface thereof and said second fixed contact piece is positioned in opposition to said depression so that said contact regions of said movable contact make electrical contact with said depression and said second fixed contact piece when said lever is in one of said first and second positions.

2. The lever switch of claim 1, wherein said operating lever includes a pair of hinge pieces each having a protruding hinge pin, and wherein said opposed substrate walls include holes which receive a respective said hinge pin.

3. The lever switch of claim 1, wherein said operating lever includes a pair of hinge pieces each having a hole, and wherein said opposed substrate walls include protruding hinge pins which are received within a respective said hole of said hinge pieces.

4. The lever switch of claim 1, wherein said operating lever includes a through hole in registry with said contact regions of said movable contact piece and a bridge piece which includes a locking tab, and wherein said moveable contact piece includes locking edges which engage said locking tab and thereby lock said moveable contact piece to said operating lever.

5. The lever switch of claim 1, comprising plural said second fixed contact pieces.

6. The lever switch of claim 5, wherein said plural second fixed contact pieces define a gap therebetween which is narrower than said contact regions of said movable contact piece.

* * * * *